US005249532A

United States Patent [19]

Perrot

[11] Patent Number: 5,249,532

[45] Date of Patent: Oct. 5, 1993

[54] WAGON ALLOWING BOGIES FOR RAILROAD TRANSPORT TO BE RECOVERED OR UNLOADED

[76] Inventor: Pierre Perrot, 6, rue Gambetta, 27320 Nonancourt, France

[21] Appl. No.: 895,857

[22] Filed: Jun. 9, 1992

[30] Foreign Application Priority Data

Jun. 10, 1991 [FR] France ..... 91 06979

[51] Int. Cl.[5] ..... B61D 47/00

[52] U.S. Cl. ..... 105/355; 104/137; 410/3; 410/7; 410/6

[58] Field of Search ..... 104/29, 137; 105/159, 105/72.2, 355, 363, 392.5; 410/2, 3, 6, 7, 93; 414/339, 537, 528, 679, 353

[56] References Cited

U.S. PATENT DOCUMENTS

| | | | |
|---|---|---|---|
| 1,280,142 | 10/1918 | Bonner | 105/159 |
| 1,699,882 | 1/1929 | Ferguson | 105/159 |
| 2,623,759 | 12/1952 | Forbas | 105/159 |
| 2,900,094 | 8/1959 | Ferguson | 414/537 |
| 3,007,588 | 11/1961 | Cull | 414/339 |
| 4,101,081 | 7/1978 | Ritter et al. | 414/528 |
| 4,388,036 | 6/1983 | Okamoto | 414/537 |
| 4,543,026 | 9/1985 | Halonen et al. | 414/352 |
| 4,909,378 | 3/1990 | Webb | 414/528 |

FOREIGN PATENT DOCUMENTS

| | | | |
|---|---|---|---|
| 2717207 | 11/1978 | Fed. Rep. of Germany | 414/537 |
| 1173693 | 4/1957 | France . | |
| 1190963 | 5/1970 | United Kingdom . | |

*Primary Examiner*—Mark T. Le

*Attorney, Agent, or Firm*—Wenderoth, Lind & Ponack

[57] ABSTRACT

A special wagon has at one end thereof a movable ramp which may be lowered simultaneously with buffers on the wagon. The movable ramp and a platform of the wagon carry rails on which the bogies can roll. Arranged in parallel with these rails are C-shaped slideways, in which are displaced chains, ends of which carry hooks for holding a bogie and for pulling it up the ramp and onto the platform. The chains and hydraulic jacks for maneuvering the ramp receive working fluid from a motor-driven pump unit via controls. The platform of the wagon carries systems for securing bogies for rail travel.

29 Claims, 3 Drawing Sheets

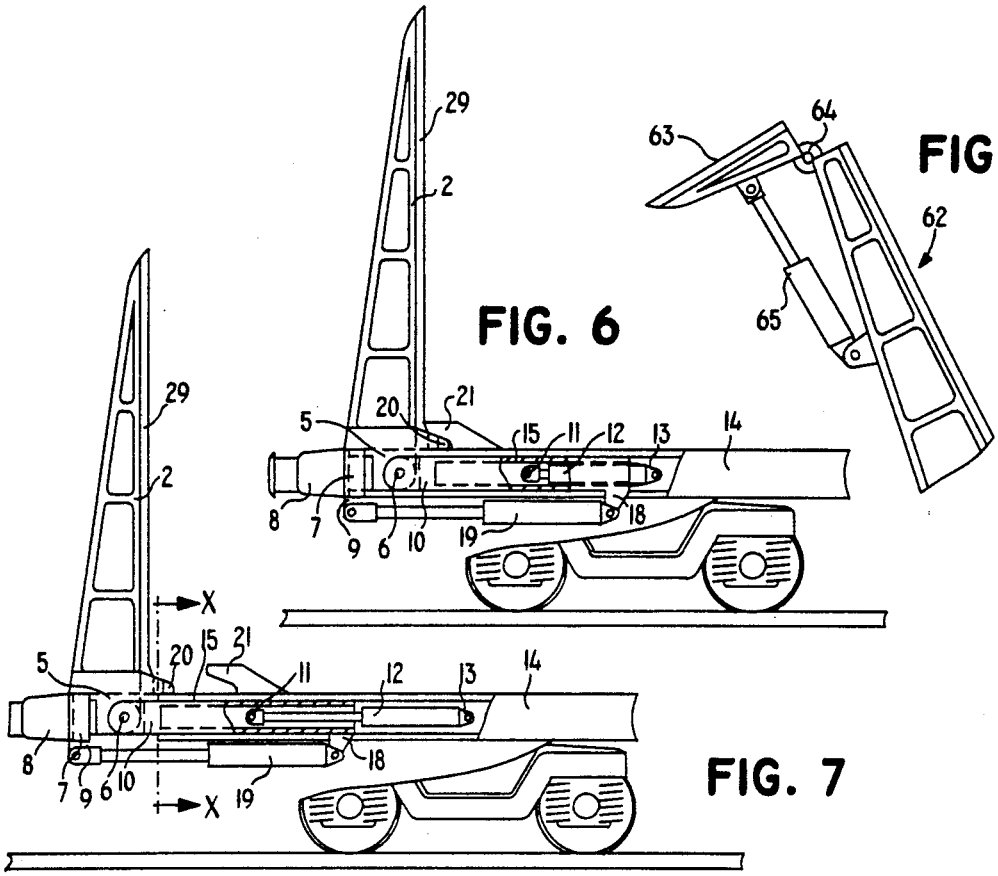
FIG. 6
FIG. 7
FIG. 5
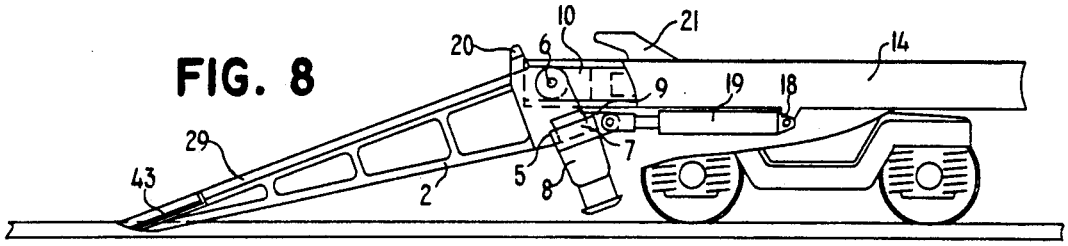
FIG. 8
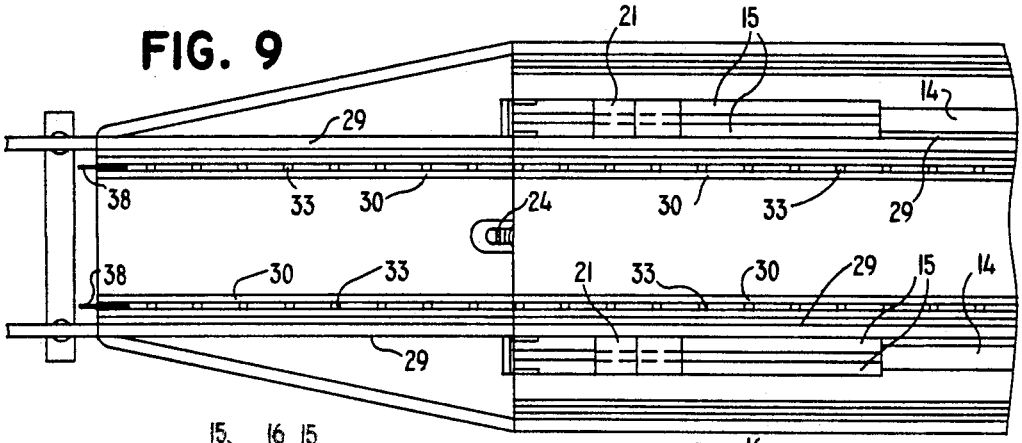
FIG. 9
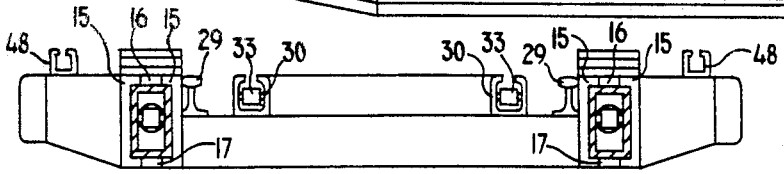
FIG. 10

WAGON ALLOWING BOGIES FOR RAILROAD TRANSPORT TO BE RECOVERED OR UNLOADED

BACKGROUND OF THE INVENTION

The present invention concerns a wagon for recovery or making available rail bogies or similar devices including at least two wheels.

At the present time, railroad vehicles of the new generation leave the rail for the road by abandoning their respective bogies. But this can be done in only a few specific centers which are not always near the place of consignment or destination. Since bogies cannot travel separately by rail, local congestion is caused by an accumulation of bogies which necessarily impede shunting operations.

SUMMARY OF THE INVENTION

The present invention is therefore aimed at providing a solution to the problem of managing bogies, by allowing them to be made available, recovered and transported at any station, without any fixed installation or handling appliance.

Another object of the invention is to reduce terminal runs as much as possible, reducing road congestion by increasing journeys by rail and, concomitantly with this, ensuring a greater and better development of the new-generation railroad system.

Yet another object of the invention is to afford a definite improvement as regards dangerous transport, solutions to many problems of logistics and a better safeguard of the environment.

According to the invention, there is provided a wagon that comprises:

a) an end ramp mechanically fixed to a buffer and articulated about a horizontal transverse axis, this ramp being provided with rails for loading or unloading bogies on the wagon, b) means for controlling the tilting of the ramp between a substantially vertical position, in which the buffer is in its use position, and a lowered position in which the ramp is inclined for loading or unloading, c) devices for securing the bogies or similar elements on the wagon for transportation of the latter when the ramp is in its raised vertical position, d) and means for driving bogies on the ramp and on the wagon for loading and unloading thereof.

The subject of the invention is, therefore, a special bogie-recovering and -carrying wagon possessing incorporated systems operating strictly independently, in order to allow the loading and unloading of bogies at any station and their transport, without any loss of support, so as to prevent any possible accident attributable to poor slinging.

Since maneuvering systems are located in a lower central part and therefore do not need any troublesome superstructure, the invention makes it possible to load, maneuver and transport bogies which, including equipment, can have the conventional total width of the wagons.

BRIEF DESCRIPTION OF THE DRAWINGS

Other particular features and advantages of the invention will emerge from the following description, made with reference to the accompanying drawings, of two embodiments and that is in no way limiting.

In the drawings:

FIG. 5 is an elevation view of another embodiment of the movable ramp equipping the wagon according to the invention.

FIG. 6 is a cutaway elevation view of a mechanism of the movable ramp in a rail-travel position.

FIG. 7 likewise is a cutaway elevation view of a mechanism of the movable ramp ready to be lowered.

FIG. 8 is yet again a cutaway elevation view of a control mechanism of the movable ramp lowered into the position of use.

FIG. 9 is a plan view from above of the special wagon, with its access ramp lowered, revealing the alignment of rails of a railway track, of the movable ramp and of the wagon platform.

FIG. 10 is a cross-sectional view of the wagon taken along line X—X of FIG. 7, showing the control devices of the movable ramp, the rails and C-sections for guiding handling chains.

DETAILED DESCRIPTION OF THE INVENTION

Figure 1:
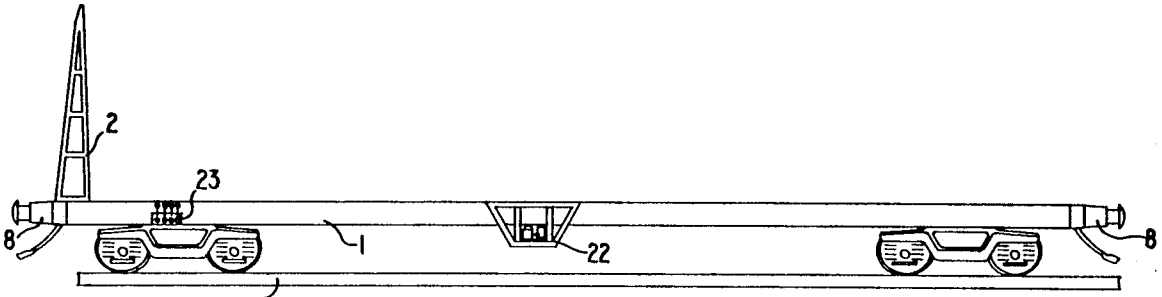
FIG. 1 is a longitudinal elevation view showing a special wagon ready to be used, carrying at one end a movable ramp for recovering bogies, and in a raised position.
Figure 2:
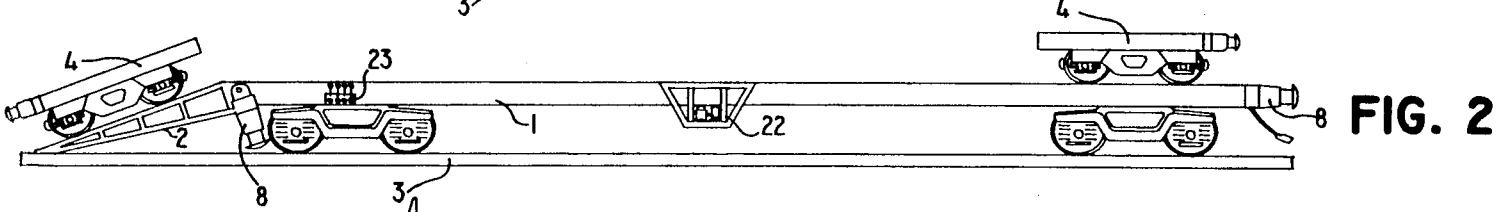
FIG. 2 is a longitudinal elevation view showing the special wagon being loaded with a bogie shown being taken up on the movable ramp that is shown lowered into a position of use.
Figure 3:
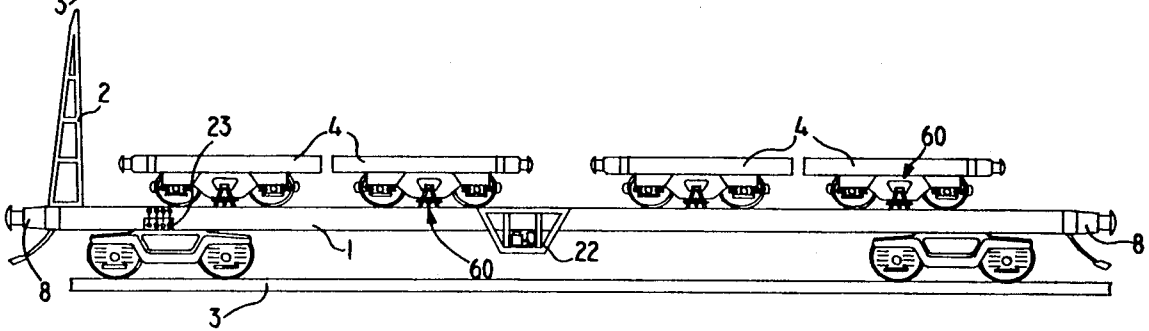
FIG. 3 is a longitudinal elevation view showing the special wagon loaded with a plurality of secured bogies and with the loading ramp raised.

A recovering and carrying wagon shown diagrammatically at 1 in FIGS. 1, 2, 3 and 4 is equipped at one end with amovable ramp 2 capable of being immobilized and locked vertically for rail travel, as shown in FIG. 1, or of bearing on rails 3, as shown in FIG. 2, to allow bogies to be loaded or unloaded.

FIGS. 6, 7 and 8 illustrate a design of a system which will make it possible to cause the movable ramp 2 to change from the vertical position to the loading position.

Figure 11:
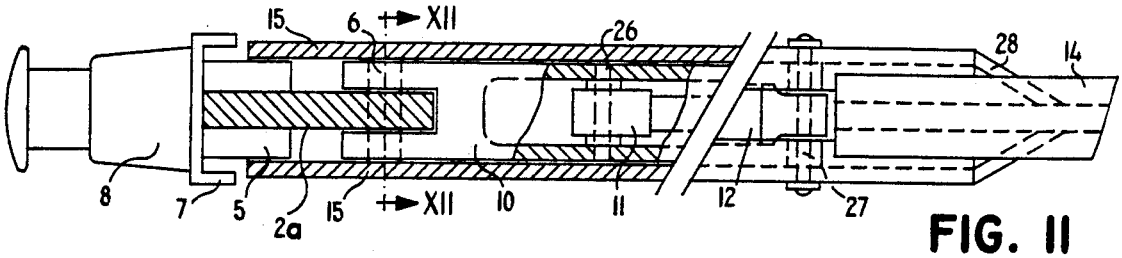
FIG. 11 is a cutaway plan view from above and in partial cross-section of one end of a longitudinal member of the special wagon on the same side as the mechanism of the movable ramp.
Figure 12:
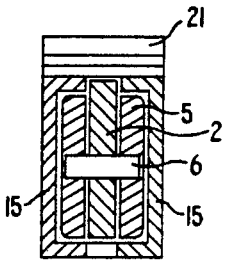
FIG. 12 is a cross-sectional view of the end of the longitudinal member taken along line XII—XII of FIG. 11.

Movable ramp 2 is fastened firmly to a tubular element 6 of a quadrangular shape, carrying at one end an articulation axle or axis 6 and at the other end a U-shaped piece 7 having vertical axis and on which is mounted a conventional railway buffer 8 (FIGS. 7, 11 and 12). The element 5 is formed by two parallel plates between which is inserted an arm 2*a* for articulation of ramp 2 on axis 6. An articulation yoke 9 is firmly fastened to the lower part of the tubular element 56 and diametrically opposite to the ramp 2.

Behind the tubular element 5 is located another tubular element 10 which has a cross-section strictly identical to that of the first element 5 and with which it is articulated in the vertical plane by means of the toggle or axle 6. Fastened inside the second tubular element 10 is an axle 26 which receives a rod head 11 of a double-acting hydraulic jack 12 bearing on an axle 13 passing through a longitudinal member 14.

The assembly consisting of the tubular elements 5 and 10 connected by means of the toggle joint or axle 6 is placed in an enveloping slideway formed by two U-shaped members 15 (FIG. 10), leaving an upper passage 16 (FIG. 10), to allow the base of the movable ramp 2 to slide, and a lower passage 17 (FIG. 10), in order likewise to allow the support of the articulation yoke 9 to slide. This assembly consisting of the tubular elements 5 and 10 can be displaced in opposite directions within the slideway consisting of the two members 15, under the action of the double-acting hydraulic jack 12.

The lower rear end of the tubular element 10 has a yoke 18, on which the head of a double-acting hydraulic jack 19 is articulated, the rod of which being articulated on the yoke 9 located in the lower part of the first tubular element 5.

In addition, located at the rear of the base of the movable ramp 2 are heel bosses 20 (FIGS. 6 and 7), and on top of each pair of the members 15 and connecting them firmly to one another are located a strong hook-shaped piece 21 (FIGS. 8 and 9), the hooking recess of which is directed towards the movable ramp 2. The importance of elements 20 and 21 will emerge clearly from the following explanation of the functioning of these mechanisms.

Before such explanation, it is essential to state that these mechanisms have complete independence of operation, in particular as a result of a motor driven pump unit 22 fastened permanently to the chassis of wagon and supplying the necessary hydraulic energy which is distributed by means of a control station 23 likewise fastened to the chassis, but arranged in such a way that it makes it possible to supervise all maneuvers. In addition to human supervision, there are hydraulic stops which interlock the displacements of the movable members so as to prevent any false maneuver. Such hydraulic stops and connection pieces, since they are of conventional construction and use, have not been illustrated to avoid excessive complexity in the drawings.

By referring to FIGS. 6, 7 and 8, it is possible to illustrate the use of one of the component parts of the present invention, namely the functioning and usefulness of the devices for positioning the movable ramp 2 according to requirements.

In FIG. 6, the movable ramp 2 is in the raised position for rail travel, and at this moment the tubular elements 5 and 10 are retracted within the slideways 15 as a result of the action of the double-acting hydraulic jack 12. Although it cannot be inclined because the tubular element 5 is immobilized within the slideways 15, the movable ramp 2 is additionally locked in the vertical position by the action of the hooks 21 on the bosses 20. The buffers 8 are in the normal position.

By operating the hydraulic jack 12, the assembly consisting of the tubular elements 5 and 10 is extended from the slideways 15 in order to assume the position shown in FIG. 7. The tubular element 5 becomes movable about its axle 6, as does the movable ramp as a result of the separation of the bosses 20 from the hooks 21. At this moment, the hydraulic stops which until this moment closed the feed of jack 19, allow the latter to function. Its activation will cause the movable ramp 2 to be lowered until its end bears on the rails 3 of the railway track. Simultaneously, the buffers 8 fastened to the end of the tubular element 5 will retract downwardly to prevent any generation of a "hump" and any needless bulk. One of the particular features of the invention is that only the buffers are movable, whereas a hook 24 ensuring traction (FIG. 9) remains in place. Consequently, therefore, no mechanical failure of any kind can have effect on the systems ensuring traction or braking. As regards the buffers, it will be seen later that the present invention also provides that they preserve and transmit all their customary efficiency by means of a special embodiment.

To cause the movable ramp 2 to return to the locked vertical position for rail travel, the procedure will take place in reverse order. In a first step, the activated hydraulic hack 19, by means of its pressure on the yoke 9, causes the horizontal positioning of the element 5 which, during its movement about axle 6, simultaneously returns the movable ramp 2 into the vertical position and the buffers into their normal position. When the tubular elements 5 and 10 are perfectly in line, this being checked automatically by the hydraulic stops, the activation of the hydraulic jack 12 will cause them to retract into the slideways 15. At the end of such travel, additional locking will take place as a result of the bosses 20 assuming position within the hooks 21. The special wagon is then ready to travel on rails.

Reference will now be made particularly to FIGS. and 12 in order to describe in more detail one of the essential features of the present invention, namely the design of one longitudinal end of the special wagon incorporating the above mechanisms.

With FIG. 11 being a cutaway plan view in partial cross-section from above and FIG. 12 being a cross-sectional view according to XII—XII of FIG. 11, it can be seen that the buffer 8 is fastened to U-shaped piece 7 having a vertical axis, which is solid with the tubular element 5, and on top of which the base of the movable ramp 2 is very firmly fastened. At the rear of this assembly 8, 7, 5 is located a vertical joint and horizontal axle 6, on which is articulated the second element 10 itself receiving the action of the double-acting hydraulic jack 12 by way of the axle 26. This entire movable assembly is placed in the two U-shaped members 15 (FIG. 11 and FIG. 12) forming a slideway and is made solid wit h the longitudinal member 14 by means of a fixed through-pin 27.

When the assembly 8, 7, 5, 10 is completely retracted as a result of the action of the hydraulic jack 12, the U-shaped piece 7 then performs a double function, i.e. it transmits the pressure received by the buffer 8 to the two members 15 and closely caps the ends thereof, consequently preventing them from spreading. This pressure received by the buffer 8 is transmitted by means of the members 15 to the longitudinal member 14, to which they are firmly connected, if necessary with structural reinforcements by gussets 28. A longitudinal buffer is thus restored, as in a conventional wagon.

To perform its basic function of recovering and transporting bogies, the present invention also provides equipment and devices additional to the above-described structure and indispensable for the maneuvering of the bogies.

Figure 13:
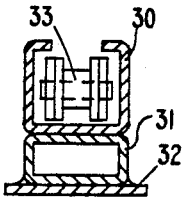
FIG. 13 is a cross-sectional view of one of two C-shaped maneuvering-chain guide slideways visible in FIGS. 9 and 10.

First of all, to ensure the normal rolling of the bogies, conventional rails 29 are fastened at the conventional gauge to the movable ramp 2 (FIGS. 6, 7, 8, 9 and 10) and over the entire length of the platform of special wagon 1 (FIG. 9). Subsequently, within and parallel to these rails 29 are installed C-shaped slideways 30 (FIG. 9) shown in section in FIGS. 10 and 13. These slideways can be adjusted vertically, if need be by fastening them to members 31 (FIG. 13), the cross-section of which will be determined by the desired elevation, and laterally by means of tabs 32 (FIG. 13) provided for this purpose, in order to be placed at the desired exact gauge.

Figure 14:
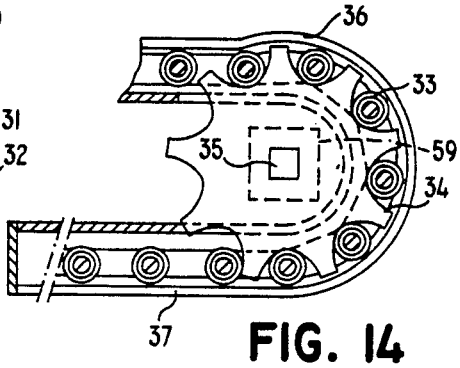
FIG. 14 is an elevation view of an end portion of a maneuvering chain and of its control gearwheel.

Arranged in these C-shaped slideways 30 are maneuvering chains 33 (FIGS. 9, 10, 13 and 14) of sufficient force to be capable of pulling a bogie 4 up the inclined movable ramp 2 (FIG. 2) and made rigid by the C-shape of the slideways 30. These handling chains are driven in opposite directions, as desired, by means of chain sprockets 34 (FIG. 14) mounted on a shaft of polygonal cross-section 35 (FIG. 14), in order, without any loss of drive, to allow an axial displacement corresponding to the lateral setting determined for the slideways 30.

The drive mechanism of the chain sprockets 34, the highly conventional principle of which is not described so as to avoid overloading of the drawings, is installed in the lower part of the special wagon platform as near as possible to the buffers 8 on the side opposite to the movable ramp 2, in order to obtain a maximum useful length of chain.

Since the chain 33, free at each end, is not held on the sprocket 34 by tension, a housing 36 (FIG. 14) peripheral to the above-mentioned sprocket serves as a chain guide by retaining the chain on the driving teeth of the sprocket. The peripheral housing 36 is continued in the lower part thereof by a likewise C-shaped slideway 37 (FIG. 14), serving as a chain magazine when the chain is driven there.

The two sprockets 34 are set in motion, after the control members, by a reversible hydraulic motor 59 receiving working fluid from the motor-driven pump unit 22 via the control station 23 (FIGS. 1–4).

Firmly fastened to the end of the handling chains 33 on the same side as the movable ramp 2 are hooks 38 which can tilt about an axis of an axle 39 (FIGS. 9 and 15–16) and which are always kept in a high position by the action of two bent lever arms 40 serving as counterweights. Arms 40 are locked angularly with the hooks 38 by means of a polygonal cross-section of the axle 39 and installed on opposite sides of each C-shaped slideway 30. The assembly 38-39-40 is mounted on a special link of the chain 33 in the form of a yoke 41 and allowing oscillation.

With the above description of this embodiment in mind, the principle of the part of this invention allowing the recovery of the bogies can be explained very easily.

Figure 15:
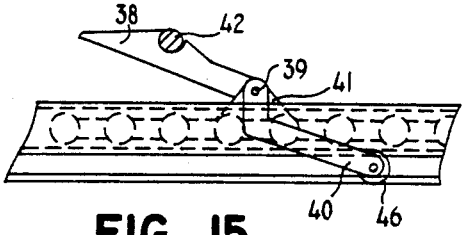
FIG. 15 is an elevation view showing a tilting hook making it possible to maneuver the bogies by automatic hooking and controlled unhooking.

Under the action of the sprockets 34, the setting in rotation of which is caused in the direction of the lowered end of the movable ramp 2 from the control station 23, the handling chains 33, rigid in their C-shaped slideways, will bring the tilting hooks 38 under a first axle of a bogie presented at the bottom of the movable ramp 2. Under the effect of the bent levers 40 serving as counterweights, the hooks 38 retain the axle 42 (FIG. 15). With the rotation of the sprockets 34 then being reversed, the axle 42 will be pulled by the chains 33, thus driving the bogie onto the movable ramp 2 and then onto the platform of the special wagon.

It may be stated that, instead of the bogie axle, the hooks 38 can take hold of any front bar or of special pieces provided and mounted for such purpose. Hooks 38 are capable of arriving at the desired locations as a result of the possibilities of adjustment of the slideways 30 and of the sprockets 34.

Figure 16:
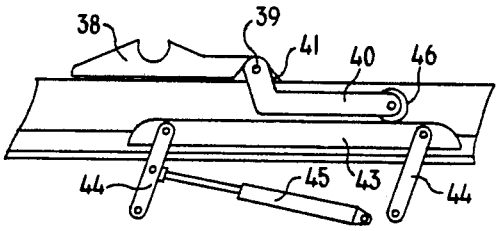
FIG. 16 is an elevation view showing a system causing the unhooking of the bogies.

To release the bogie from the hooks 38, a special device, which shows another expedient feature of this invention and which is shown diagrammatically in FIG. 16, has been designed.

On the platform of the special wagon there is an unhooking zone which is of a length substantially equal to that of a ramp 43 (FIG. 16), but the location of which will be determined in such a way that action can take place on the hooks 38 only after a complete and definite movement of the bogie onto the platform of the special wagon. Devices are installed on either side of each of the C-shaped slideways 30 so that they act simultaneously on the two bent lever arms 40 of each hook 38. Each device consists principally of the double-entry ramp 43 made vertically movable by means of the two arms 44 which support it and which form a parallelogram deformable as a result of the action of a jack 45 controlled from the control station 23.

When the bogie is to be released from its pull hooks 38, it is sufficient to put the movable double-entry ramp 43 into the high position by the action of the jack 45. With the movement of the pull chains 33 continuing towards the rear of the wagon, rollers 46 of the chains climb up the ramp 43, causing the raising of the bent levers 40 which, in their rising movement drive the hooks 38 in a descending movement which detaches them from the axle 42 of the bogie and releases it (FIGS. 15–16).

It is then possible, by maneuvering the chains 33 towards the end of the movable ramp 2, to fetch another bogie on the railway track. The bogies 4 arriving one after the other on the platform of the special wagon 1 will take their places one after the other and be pushed by the last bogie still under the action of the maneuvering chains 33.

Although the foregoing illustrates the principle of recovering the bogies from the railway track, the invention also allows the reverse operation, i.e. depositing the bogies on the railway track in order to make them available to users.

For this purpose, after devices 60 securing the bogies on the wagon have been removed, the chains 33 will be activated so that the hooks 38 can take hold of the rear axle of an end bogie on the same side as the movable ramp 2 when the ramp is lowered for handling purposes. The hooks 38, being double-acting, ensure both pushing of the bogie towards the ramp and its retention when engaged by the hooks.

At the bottom of the movable ramp 2 there is likewise a device which is identical to that shown diagrammatically in FIG. 16 and the principle and functioning of which were described previously, and the activation of jack 45 thereof will then release the bogie onto the railway track. For the end unhooking system (FIG. 16) of the movable ramp 2, the length of the hooks 38 and bent arms 40 is designed in such a way that unhooking takes place at the moment when all the wheels of the bogie bear on the railway track and the assembly as a whole can be accommodated under the end of the movable ramp 2 between the rails of the railway track.

Figure 4:
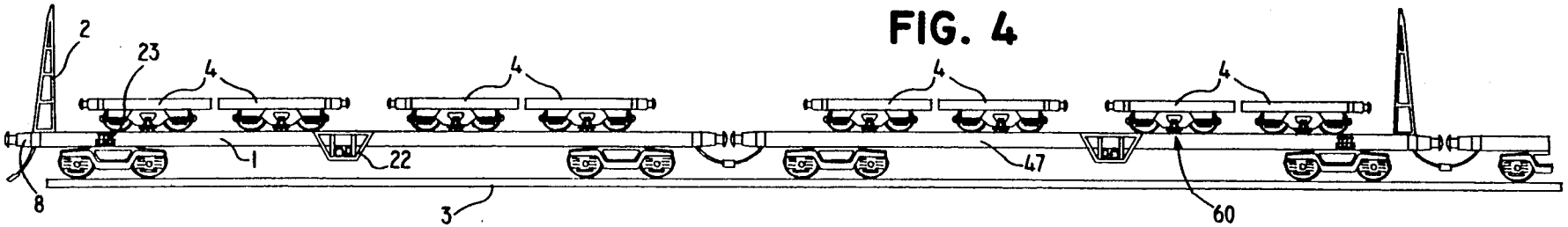
FIG. 4 is a longitudinal elevation view of a convoy of bogies with one special wagon equipped with the loading system and another complementary wagon simply performing a carrying function.

The foregoing description explains the mechanism of the movable ramp and the recovery and making available of the bogies. It can happen that, despite the use of a special wagon which is as long as possible, the bogies to be recovered are too numerous to be accommodated on the special wagon. The present invention therefore provides the addition of wagons 47 solely for carrying bogies (FIG. 4). These wagons will be connected to the special wagon 1 during loading periods by means of a movable crane of the type already used for rail stock, and their platform will be equipped with the rails 29 and with securing slideways 40 (FIG. 10). The bogies will take their place on wagons 47 one after the other, pushed by the maneuvering system of the special wagon.

Although the bogies can have incorporated immobilizing brakes, they will be secured to the wagons by means of devices 60 exhibiting another characteristic particular to the invention and described below.

Fastened in the vicinity of the lateral edges of the special wagons or carrying wagons are resistant steel slideways 48 (FIGS. 10, 17 and 18), in which are introduced small carriages 49 (FIG. 19) each carrying, in an upper part thereof, a ring 50 (FIGS. 17, 18 and 19) and toothed elements 51 made of high-carbon steel 51 and, in a lower part thereof, castors 52 to make it easier to maneuver them. Articulated in the rings 50 are movable arms 53 (FIGS. 17 and 18) which converge toward and are mounted on a piece 54 terminating in a strong hook. Placed in the middle of the movable arms 53 are twin-stub nuts 55 (FIGS. 17 and 18) internally threaded in reverse, i.e. having right-hand and left-hand threads. Located in these twin-stub nuts is a strong rod 56 having at its center an operating handwheel 57 and opposite ends with right-hand or left-hand threads according to the corresponding nut into which it is threaded. The arrangement of the twin-stub nuts 55 is such that, by rotating the handwheel 57 in the direction of the arrow in FIG. 18, the movement of the rod 56 causes the movable arms 53 to spread apart.

Figure 17:
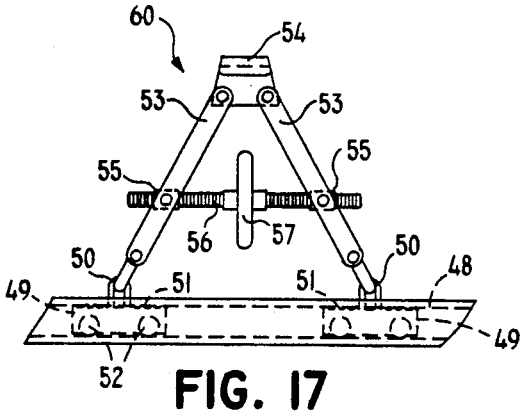
FIG. 17 is an elevation view of an articulated triangle for securing of the bogies.
Figure 18:
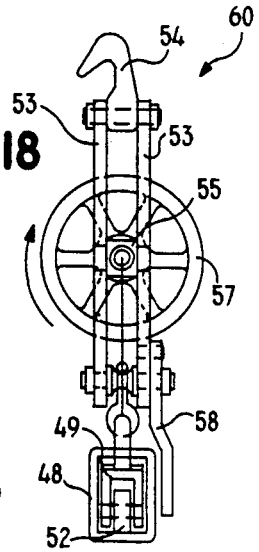
FIG. 18 is a profile view of the triangle of FIG. 17.
Figure 19:
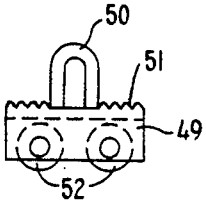
FIG. 19 is an elevation view of a block of the articulated triangle shown in FIGS. 17 and 18.

The securing devices 60 illustrated in FIGS. 17, 18 and 19 function as follows. By means of the small carriages 49, a device 60 is brought vertically into line with a loaded bogie and at an exact location where the hook 54 can firmly take hook the bogie. By rotating the handwheel 57 in a direction to spread apart arms 53, the hook 54 is pulled downwards, thus lifting the small carriages 49. A vigorous clamping is achieved by hook 54 on the bogie and by carriages 49 on the upper wings of the slideway 48. The small carriages 49 are blocked by means of their steel teeth 51 in the slideway. The movable arms 53 then act as buttresses and prevent any oscillation of the bogie which is thus secured perfectly, thereby allowing any movement of the special or carrying wagons.

Firmly fastened to the lower part of the movable arms 53 and towards the outside of the wagon are tabs 58, the shape of which is designed to bear on the lateral wall of the slideways 48 (FIG. 18), thus preventing the securing mechanism from tilting outward and beyond the rail clearance. This safeguard is essential to avoid possible accidents during station maneuvers or rail travel. To show the triple function of the small carriages (FIG. 19) clearly, the tabs 58 have not been shown in FIG. 17.

FIG. 5 shows a second embodiment of a ramp 62 that includes an end portion 63 foldable about an articulation 64 due to a control jack 65 mounted on the ramp. This arrangement permits, if necessary, to reduce ramp height during rail travel, thus allowing the passage of the ramp and reducing the access slope.

I claim:

1. A wagon for transporting rail bogies, said wagon comprising:

an end ramp affixed to an end buffer of said wagon and articulated about a horizontal transverse axis at an end of said wagon;

a pair of rails provided on said end ramp for loading and unloading bogies onto and from said wagon;

means for moving said end ramp between a substantially vertical position for travel and an inclined position for loading and unloading bogies and for moving said buffer between operative and inoperative positions;

devices on said wagon for securing bogies on said wagon during travel; and means on said end ramp and said wagon for moving bogies along said end ramp and said wagon.

2. A wagon as claimed in claim 1, wherein said end ramp moving means and said bogie moving means are fluid operated, and further comprising a motor driven pump unit mounted on a chassis of said wagon and connected via a control panel to said end ramp moving means and said bogie moving means for supplying pressurized fluid thereto.

3. A wagon as claimed in claim 1, wherein said end ramp and said buffer are mounted on a first element that is pivotable about an axle defining said axis, and further comprising means for displacing an assembly comprising said axle, said first element, said end ramp and said buffer in opposite directions longitudinally of said wagon.

4. A wagon as claimed in claim 3, wherein said displacing means is operable to move said assembly between a retracted position whereat said end ramp is locked in said vertical position and a released position whereat said end ramp moving means is operable to pivot said end ramp between said vertical and inclined positions.

5. A wagon as claimed in claim 4, whereat said end ramp moving means is operable only when said assembly is in said released position.

6. A wagon as claimed in claim 4, wherein said displacing means comprises a second element, articulated to said axle and displaceable with said assembly in said opposite directions, and a double-acting jack connected to said second element for imparting movement to said second element and to said assembly in said opposite directions.

7. A wagon as claimed in claim 6, further comprising a guideway mounted on said wagon, said first and second elements being slidably mounted in said guideway for movement relative thereto in said opposite directions.

8. A wagon as claimed in claim 7, wherein said buffer is fixed to a U-shaped member that is fixed to said first element and that has spaced legs extending vertically when said end ramp is in said vertical position, said guideway is defined by two longitudinal members, and said U-shaped member abuts adjacent ends of said two longitudinal members when said assembly is in said retracted position, with said spaced legs enclosing said longitudinal members laterally, such that force imparted to said buffer is transferred through said U-shaped members and longitudinally through said longitudinal members to said wagon, and such that said spaced legs prevent lateral outward spreading of said ends of said longitudinal members.

9. A wagon as claimed in claim 6, wherein said end ramp moving means comprises a hydraulic jack connected between said first and second elements and operable to pivot said first element about said axle when said assembly is in said released position.

10. A wagon as claimed in claim 4, further comprising means to lock said end ramp in said vertical position when said assembly is in said retracted position.

11. A wagon as claimed n claim 10, wherein said lock means comprises a hook fixedly positioned on said wagon and a boss fixed to said end ramp and insertable into said hook when said assembly displaces to said retracted position.

12. A wagon as claimed in claim 1, wherein said bogie moving means comprises at least one chain mounted for movement along said wagon and said end ramp when said end ramp is in said inclined position, and hook means connected to said chain for hooking a bogie and during movement of said chain moving the bogie along said end ramp and said wagon.

13. A wagon as claimed in claim 12, comprising plural chains and hook means.

14. A wagon as claimed in claim 12, further comprising means mounted on said wagon for imparting movement to said chain in opposite directions.

15. A wagon as claimed in claim 14, wherein said movement imparting means comprises a sprocket shaft rotatable by a motor, and a sprocket mounted on said shaft for rotation therewith and engaging said chain.

16. A wagon as claimed in claim 15, wherein said shaft has a non-circular cross section, and said sprocket is adjustable axially relative to said shaft.

17. A wagon as claimed in claim 16, further comprising a housing closely enveloping of said chain to maintain said chain in engagement with said sprocket.

18. A wagon as claimed in claim 12, further comprising C-shaped slideways mounted on said end ramp and on a platform of said wagon, said chain being housed internally of said slideways for movement longitudinally therein, and said hook means extend from said chain through a particular said slideway to externally thereof.

19. A wagon as claimed in claim 18, wherein said slideways are mounted on said end ramp and on said platform for adjustment laterally thereof and vertically thereof.

20. A wagon as claimed in claim 12, wherein said hook means comprises a hook member pivoted to said chain and having a hook, and a counterweight fixed to said hook member to pivot said hook member relative to said chain in a direction such that said hook projects outwardly from said chain.

21. A wagon as claimed in claim 20, wherein said counterweight comprises a bent lever, and said hook member and said bent lever are articulated to said chain for pivoting movement about an axis defined by an axle, such that when said chain is moved along said end ramp and said wagon said hook is operable to engage a bogie and move such bogie along said end ramp and said wagon.

22. A wagon as claimed in claim 21, further comprising means mounted on said wagon or on said end ramp for causing said hook to disengage the bogie when the bogie has been moved to a predetermined position along said wagon or said end ramp.

23. A wagon as claimed in claim 22, wherein said disengage means comprises a ramp mounted on said wagon at a position to be abutted by said bent lever upon movement of said chain such that the bogie is in said predetermined position and thereby to pivot said bent lever and hook member about said axle in a direction to move said hook out of engagement with the bogie.

24. A wagon as claimed in claim 23, wherein said ramp is mounted on said wagon by two articulated arms controlled by a double-acting jack to move said ramp vertically relative to said wagon.

25. A wagon as claimed in claim 1, wherein said securing devices comprise members selectively movable along said wagon and operable to clamp bogies thereon.

26. A wagon as claimed in claim 25, comprising at least one slideway fixed to said wagon adjacent a longitudinal edge thereof, and each said member comprises carriages mounted for movement internally along said slideway, arms articulated at first ends thereof to respective said carriages, a hook member articulated to second ends of said arms, and means for selectively moving said first end of said arms in opposite directions away from each other or toward each other, thereby moving said hook member toward said slideway to clamp therebetween a bogie or moving said hook member away form said slideway to release clamping of a bogie.

27. A wagon as claimed in claim 26, wherein each said carriage has lower castors to ride on a lower surface or said slideway and upper toothed members to be clamped against said slideway.

28. A wagon as claimed in claim 26, wherein said hook member moving means comprises a screw shaft having oppositely threaded ends engaged n correspondingly threaded nuts mounted on respective said arms, whereby rotation of said shaft in opposite directions moves said nuts and said arms in said opposite directions toward or away from each other.

29. A wagon as claimed in claim 26, further comprising tabs mounted on said arms and extending therefrom and bearing on a lateral wall of said slideway.

* * * * *